United States Patent [19]

Dibrell

[11] 4,449,379

[45] May 22, 1984

[54] METHOD AND APPARATUS FOR EXTRACTING HEAT AND MECHANICAL ENERGY FROM A PRESSURED GAS

[75] Inventor: Edwin W. Dibrell, San Antonio, Tex.

[73] Assignee: Centrifugal Piston Expander Inc., San Antonio, Tex.

[21] Appl. No.: 436,412

[22] Filed: Oct. 25, 1982

[51] Int. Cl.[3] ..... F25D 9/00

[52] U.S. Cl. ..... 62/401; 62/467 R; 62/499; 165/86

[58] Field of Search ..... 62/467, 499, 401, 403; 165/86

[56] References Cited

U.S. PATENT DOCUMENTS

| | | | |
|---|---|---|---|
| 1,323,785 | 12/1929 | Nichol | 62/403 |
| 1,511,985 | 10/1924 | Spencer | 62/403 |
| 2,174,584 | 10/1939 | Imus | 62/136 |
| 2,175,162 | 10/1939 | Waterfill | 62/136 |
| 2,716,971 | 9/1955 | Sykes | 123/46 |
| 2,730,874 | 1/1956 | Schelp | 62/402 |
| 3,052,106 | 9/1962 | Sampietro et al. | 62/402 |
| 3,648,670 | 3/1972 | Siddons | 123/43 R |
| 3,896,632 | 7/1975 | Huntley | 62/88 |
| 4,022,032 | 5/1977 | Nott | 62/499 |
| 4,197,715 | 4/1980 | Fawcett et al. | 62/467 R |

*Primary Examiner*—Ronald C. Capossela

*Attorney, Agent, or Firm*—Wilson, Fraser, Barker & Clemens

[57] ABSTRACT

The disclosure provides an apparatus for extracting heat and/or mechanical energy from a pressured gas wherein the pressured gas is applied to the radially outer ends of rotating cylinder elements defining logitudinally extending fluid pressure chambers having one end thereof remote from the axis of rotation and the other end proximate to the axis of rotation. A free piston is mounted in each of the fluid pressure chambers and is reciprocable therein solely under the influence of the gas pressure and centrifugal force. Valving elements are provided at the outer end of the cylinder elements which are operable by the movement of the free piston toward such outer end to open the pressured gas inlet valve. A second valving element is provided near the inner end of each fluid pressure chamber to open ports causing the exhaust of the expanded, cooled gas from the chamber. The fluid pressure chambers accommodating such free pistons may be cylindrical, longitudinally curved, spirally shaped, or of a spiral-helical configuration. The free pistons comprise ball-shaped or ellipsoid-shaped elements capable of traversing the longitudinally curved fluid pressure chambers and are coated with an organic plastic having lubricating and sealing properties.

39 Claims, 13 Drawing Figures

METHOD AND APPARATUS FOR EXTRACTING HEAT AND MECHANICAL ENERGY FROM A PRESSURED GAS

BACKGROUND OF THE INVENTION

1. Field of the Invention

The invention relates to a method and apparatus for efficiently extracting heat and mechanical energy from a pressured gas by expanding same in a rotating fluid pressure chamber.

2. Description of the Prior Art

Many mechanisms and methods have heretofore been proposed for effecting the extraction of heat from a refrigerant fluid as one step in the operation of an air conditioning or refrigerating system. The most common method of heat removal is by conducting the heated refrigerant fluid through a heat exchanger and subjecting it to the cooling action of a flow of cooling air or water. Such systems necessarily involve the location of the cooling mechanism exteriorly of the space to be air conditioned or refrigerated. Most conventional cooling systems therefore required one motor to effect the compression of the refrigerant fluid to convert it from a gas to a liquid and to drive a cooling fan for removing the heat involved in the compressor operation, and a second motor to move room air through an evaporator. The cooling was achieved by evaporation of the liquified refrigerant fluid in the evaporator to produce a cooling effect on air or other fluid stream passing in proximity to the evaporator. In any event, most prior art systems involve the use of substantial amounts of energy to effect the desired cooling action. Furthermore, special refrigerant fluids, such as Freon, were required.

In the co-pending application of James G. Adams, Ser. No. 343,240, filed Jan. 28, 1982, and assigned to the assignees of the instant application, there is disclosed a prime mover for an air conditioning system which involves the extraction of both heat and mechanical energy from a pressured refrigerant gas through the non-combustible expansion of such gas in a piston and cylinder assembly wherein the piston and cylinder are relatively movable with respect to each other. Such piston and cylinder assemblies are, however, mounted on a rotating supporting body and positioned on such body so that the path of relative linear movement of the piston and cylinder elements is disposed in a plane substantially normal to the axis of rotation and is radially displaced from the axis of rotation. Such location of the piston and cylinder elements effects displacement of the movable one of such elements to a radially outward position as a consequence of centrifugal force generated by the rotation of the piston and cylinder assembly by the rotating body. A charge of pressured gas is introduced into the piston and cylinder assembly so as to cause a relative movement of the piston and cylinder elements in a direction in opposition to the centrifugal forces acting thereon. The gas pressure reaction force assists in driving the rotating body, while the concurrent expansion of the pressured gas results in a substantial cooling of the confined body of pressured gas. Hence, the movable one of the piston and cylinder elements assumes a radially inner position at which point exhaust ports are traversed by the piston, permitting the expanded and cooled gas to be exhausted in a chamber defined by an enclosure shell which surrounds the rotating body and the piston and cylinder assemblage.

The apparatus disclosed in the aforementioned James G. Adams application then proposed to effect a compression of the expanded and cooled gas through the centrifugal action of the rotating chamber within which such cooled gas was discharged. Further experimentation has revealed the fact that excessively high rotational speeds of such rotating chamber would be required to effect the condensation of the cooled gas solely by centrifugal force. At the same time, the higher the rotational speed of the rotating body, the higher the pressure of the gas that must be supplied to the cooperating piston and cylinder elements in order to effect displacement of such elements against the ever increasing centrifugal forces.

In such prior art apparatus, a connecting rod has been secured to each of the piston elements, and such connecting rods were in turn respectively connected to rocker arms provided on a hub which was rotatable about the axis of the rotating body carrying the piston and cylinder elements. Additionally, each cylinder had to be pivotally mounted on the rotating body. The oscillating movement of the hub imparted by the piston connecting rods was employed to operate control valves for supplying pressured fluid to, or removing cooled expanded gas from the cylinder chambers. Such connecting rods, hub mechanism and cylinder pivot mountings constituted expensive items to fabricate and maintain in the apparatus.

SUMMARY OF THE INVENTION

This invention provides a plurality of cylinder elements mounted on a body for rotation about an axis wherein the cylinder elements define a path for oscillating movements of a cooperating piston which, in most cases, lies in a plane perpendicular to the axis of rotation and extends from a point proximate to the axis of rotation to a point remote from the point of rotation. Thus, the piston elements are biased by centrifugal force to the radially outermost end of their path of movement.

In my co-pending application Ser. No. 418,651, filed Sept. 16, 1982, there is disclosed a method and apparatus for more efficiently utilizing the expanded cooled gas which is discharged from the rotating cylinders of the Adams construction after the pistons reach their radially inner position. Additionally, there is disclosed a valving arrangement directly operated by the pistons.

In accordance with this invention, no connecting rods are provided for the pistons, and each piston comprises a literally free body which responds only to the fluid pressure forces exerted upon it by successive charges of pressured gas and the centrifugal forces imparted to it from the rotation of the rotating body. Additionally, each cylinder is rigidly mounted on the rotating body.

The reciprocating movement of such free pistons nevertheless effects the extraction of heat from each charge of gas supplied to the piston and cylinder element by expansion of the gas as the piston is driven inwardly by the charge of gas against the bias of centrifugal force. The reaction force of such expanding gas is exerted on the end of the cylinder in a direction that imparts additional rotational energy to the rotating body. Thus, a plurality of completely independent, free pistons respectively mounted in cylinder elements carried by a rotating body can extract heat and mechanical energy from successive charges of pressured gas applied to the cylinder elements. More importantly, the utilization of a free piston permits the path of movement of the piston defined by the cylinder to assume an arcuate or curved configuration, which means that the outer end of the corresponding curved cylinder may lie in a radial plane for the more effective application of torque to the rotating body by the reaction force of the expanding gas in the curved cylinder. The external contour of the piston is selected to permit the sliding yet sealing movement of the piston along the entire length of the curved cylinder. Thus, pistons in the shape of balls or ellipsoids are employed having an external coating of a durable organic, lubricating and sealing material such as the product marketed under the trademark "Teflon".

Further objects and advantages of this invention will be readily apparent to those skilled in the art from the following detailed description, taken in conjunction with the annexed sheets of drawings, on which is shown the preferred embodiments of the invention.

DESCRIPTION OF PREFERRED EMBODIMENTS

Figure 2:
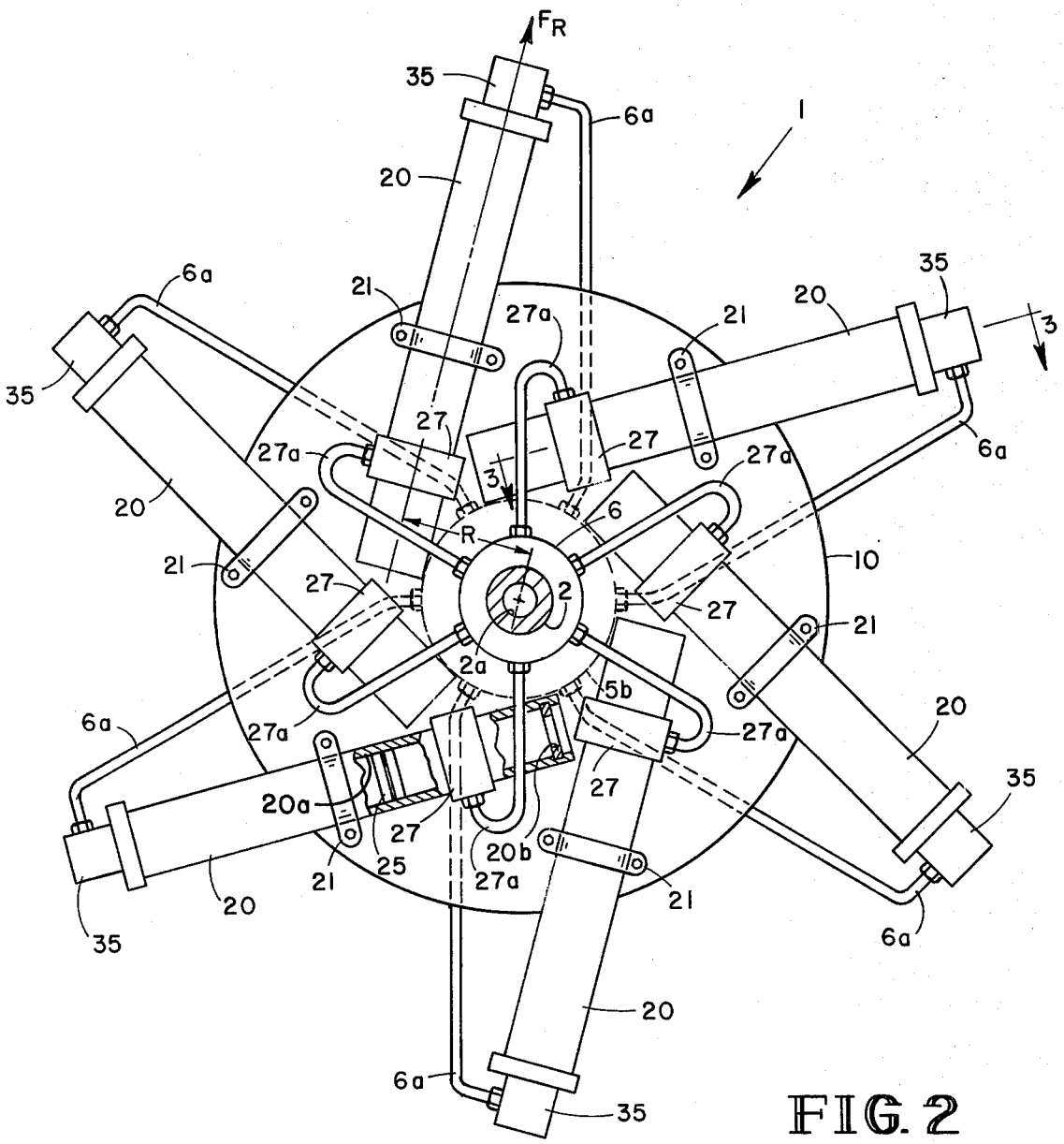
FIG. 2 is a sectional view, taken on the plane 2—2 of FIG. 1.
Figure 1:
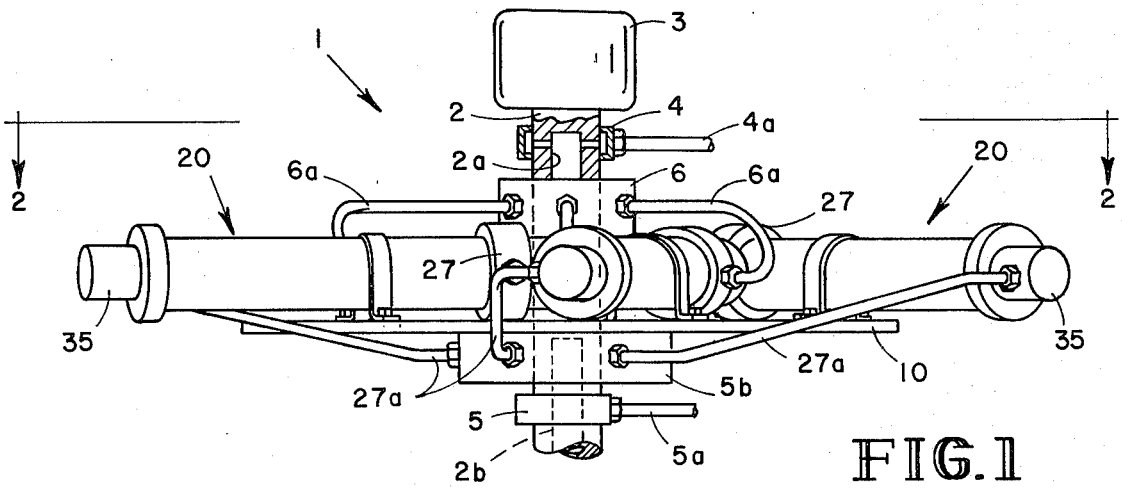
FIG. 1 is a schematic elevational view, partly in section, of an apparatus constructed in accordance with this invention primarily for the purpose of extracting mechanical energy from a source of pressured gas.

Referring to FIGS. 1 and 2, an apparatus 1 for extracting heat and mechanical energy from a pressured gas is schematically illustrated. Such apparatus is mounted on a circular plate 10 which in turn is keyed to a shaft 2 which is rotated by a suitable electric or fluid pressure starting motor 3. A conventional fluid shaft coupling 4 effects the supply of pressured fluid to the apparatus from a stationary supply pipe 4*a* through a hollow bore portion 2*a* of the shaft 2 and into a distributor 6. The expanded and cooled exhaust gases are removed from the apparatus through a conventional fluid shaft coupling 5 and supplied to a stationary exhaust pipe 5*a*. The exhaust coupling 5 communicates with another hollow portion 2*b* of the shaft 2 which, however, is isolated by a suitable barrier (not shown) from the hollow bore portion 2*a* receiving the pressured inlet gases. Shaft bore portion 2*b* communicates with an exhaust gas collector 5*b*.

To optimize the performance of the apparatus 1, a plurality of cylinder elements 20 are rigidly mounted on the rotating body plate 10. Each such cylinder element defines a fluid pressure chamber 20*a* having a longitudinal axis which extends from a point proximate to the axis of rotation of the body 10 to a point radially remote from the axis of rotation. Each longitudinal axis of the cylinders 20 is, however, not radially disposed with respect to the axis of rotation of shaft 2 but is spaced therefrom.

To optimize the performance of the apparatus 1, as many of the cylinders 20 are applied to the rotating body plate 10 as can be physically accommodated thereon. The exact number employed depends on a number of design factors, such as the pressure of the gas that is available to drive the unit, the space available to accommodate the unit, the rotational speed desired, and the weight limitations for the unit. Obviously, the larger the diameter of the individual cylinders 20, the smaller will be the total number of such cylinders that can be physically mounted on the body plate 10. Likewise, the length of the cylinders 20 substantially increases the centrifugal forces acting on such cylinders and thus requires an increase in weight and strength of the cylinder component 20, as well as the body mounting plate 10 and the power driven shaft 2. In the specific example illustrated in the drawing, six of such cylinder units 20 are shown, and they are respectively secured to body plate 10 by bolted bands 21.

A free piston 25 is mounted in each of the bores 20*a* defined by the cylinders 20 for slidable and sealable movements therealong. Since the bore 20*a* is of cylindrical configuration, conventional piston rings (not shown) could be employed on the pistons 25 or, alternatively, the pistons could be provided with an external coating of an organic material having good lubricating and sealing properties, such as a polytetrafluoroethylene, sold under the DuPont Trademark "Teflon", or a perfluoroelastomer, sold under the DuPont Trademark "Kalrez".

Figure 3:
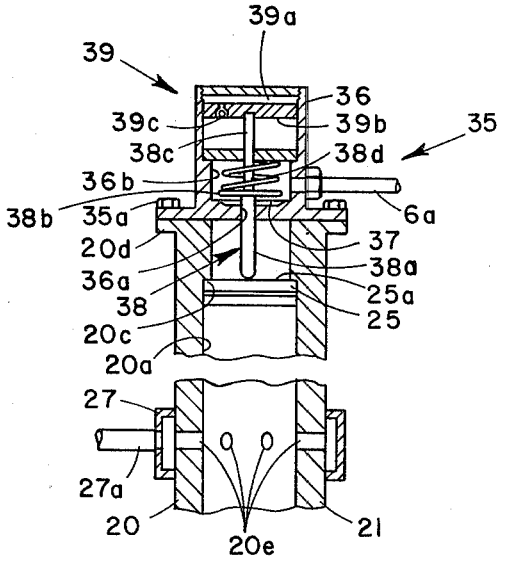
FIG. 3 is an enlarged scale sectional view, taken on the plane 3—3 of FIG. 2.

Radially inward movement of each piston 25 is limited by a snap ring 20*b* mounted in the resepctive cylinder 20, and outward movement by a shoulder 20*c*. At the outer end of each cylinder 20, an outwardly projecting flange 20*d* is provided to permit a valving unit 35 to be secured thereto by suitable bolts 35*a*. Each valving unit 35 (FIG. 3) comprises an annular block 36 defining a central bore 36*a* and an enlarged valving chamber 36*b* communicating with such bore. A valve seat 37 is provided at the juncture of the central bore 36*a* and enlarged chamber 36*b* and a stem type valve 38 cooperates with valve seat 37, being normally urged to a closed, sealing position by heavy spring 38*d*. Spring 38*d* will maintain valve 38 in its closed position under maximum fluid pressure conditions in fluid pressure chamber 20*a*.

Stem valve 38 is provided with a stem 38*a* which extends into the interior of the fluid pressure chamber 20*a* of the respective cylinder 20 and is engaged by the outer face 25*a* of piston 25 as such piston reaches its extreme outward position wherein it abuts the internal shoulder 20*c* defined within the cylinder 20. In such extreme outward position, the valve head 38*b* of the stem valve 38 is lifted from engagement with the valve seat 37.

Pressured gas is supplied to valve chamber 36*b* by a conduit 6*a* which connects with the gas distributor 6 concentrically mounted on the opposite face of the mounting plate 10. As previously mentioned, pressured gas is supplied to the distributor 6 through the fluid coupling 4 and the hollow bore portion 2*a* of the rotating power shaft 2.

From the description thus far, it will be apparent that the pistons 25 move to their outermost positions in the respective fluid pressure chambers 20*a* by the centrifugal force generated by the rotation of power shaft 2 by the starting motor 3. When each piston 25 approaches its outermost position, it contacts the inwardly projecting valve stem 38*a* and moves the valve 38 to its open position against the bias of spring 38*d*. Hence, a charge of pressured gas is introduced into the outer end of the cylinder chamber 20*a* and, if the pressure of such charge is sufficiently high, each piston 25 will be moved inwardly by the force generated by such gas. Obviously, as each piston 25 moves inwardly, the centrifugal force acting on the piston decreases, so that once its inward motion is started, it will continue.

As discussed in my aforementioned patent application Ser. No. 418,651, the reaction force of the charge of pressured gas is exerted on the end wall of the fluid pressure chamber 20*a*. This force is diagrammatically illustrated in FIG. 2 by the arrow labeled $F_R$. It will be seen that the effective torque exerted by the force $F_R$ is the product of such force by the distance R existing between the axis of the fluid pressure chamber 20*a* and the axis of rotation of the hollow body 10 and shaft 2.

As the piston 25 initiates its inward movement, it permits the stem valve 38 to close, thus, trapping the charge of pressured gas. Such gas is expanded and cooled while acting on the piston 25 to drive it inwardly. The expanded, cooled gas is discharged through a second valve element comprising a plurality of radial ports 20*e* formed in the cylinder wall which are uncovered by the piston 25 just prior to such piston reaching the end of its inward stroke. An annular header 27 is provided in surrounding relationship to the exhaust ports 20*e* and conducts the expanded, hence, cooled charge of gas through a conduit 27*a* and thence to the exhaust gas collector 5*b* and to the stationary exhaust conduit 5*a* through fluid coupling 5.

When it is desired to optimize the power generating characteristics of the aforedescribed apparatus, obviously the more pressured gas that can be introduced into each fluid pressure chamber 20*a*, the greater will be the reaction force and hence, rotation producing torque exerted on the rotatable body 10 and shaft 2. In accordance with this invention, a conventional adjustable dash pot 39 (FIG. 3) is provided to selectively control the rate of return of the stem valve 38 to its fully sealed position, thus extending the period of time that a pressured gas is permitted to enter the fluid pressure chamber 20*a*. Dash pot 39 comprises an oil filled chamber 39*a* formed in block 36 within which a piston 39*b* slidably cooperates. Piston 39*b* is in turn secured to an outwardly projecting stem 38*c* provided on the outer face of the stem valve 38. An adjustable flow check valve 39*c* is mounted in a bypass aperture provided in piston 39*b* and, in conventional fashion, permits free flow of fluid through the piston 39*b* during the outward movement of the stem valve 38, but provides a restricted passage for any fluid flow when the stem valve 38 is attempting to return to its inner sealed position. Thus, the length of time that the fluid pressure chamber 20*a* is connected to a source of pressured gas may be conveniently varied by varying the setting of the adjustable check valve 39*c*.

Figure 4:
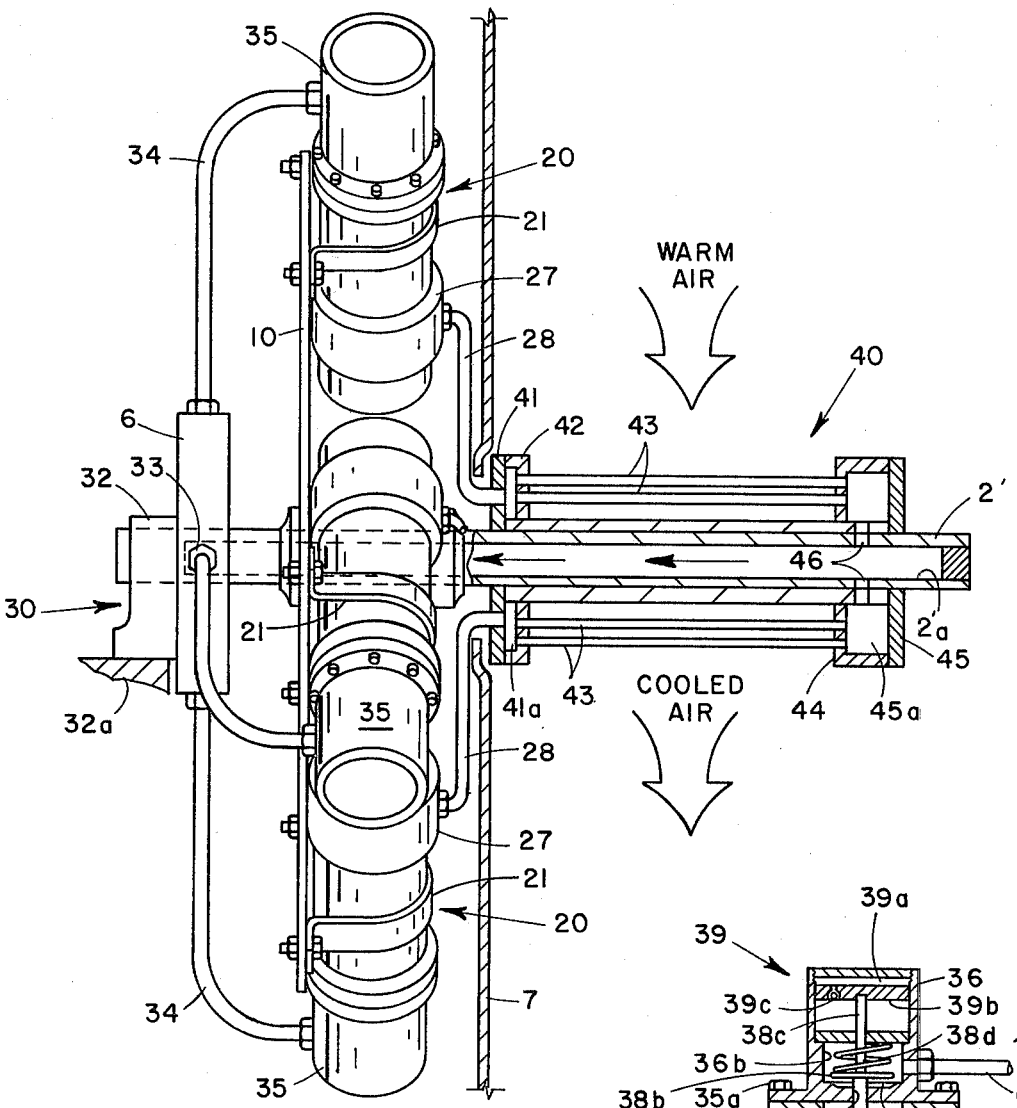
FIG. 4 is a side elevational view, partly in section, of an apparatus constructed in this invention and designed primarily to function as a room air cooling device, wherein the refrigerant fluid is re-circulated in a closed cycle.

Referring now to FIG. 4, wherein similar numerals represent identical structures, there is shown the apparatus 1 connected to function as a room air cooling device, wherein a refrigerant fluid is recirculated in a closed cycle. The refrigerant fluid may comprise any of the well known refrigerant gases, such as Freon, but also may constitute ordinary gas since the cooling cycle employed does not require the conversion of gas to a liquid and vice versa as part of the cooling cycle.

A heat exchanger 40 is mounted in surrounding, rotatable relationship to the power shaft 2'. Conduits 28 are provided which interconnect each annular header 27 which receives the cooled expanded charges of gas, to the inlet of heat exchanger 40. Heat exchanger 40 comprises a first end plate member 41 which receives the ends of fluid conduits 28. Immediately adjacent to the end plate 41, there is secured a header 42 which provides a mounting for a plurality of peripherally spaced, axially extending tubes 43 which have their opposite ends mounted in a header 44 generally similar to the header 42. A second end plate 45 is secured to the second header 44. Annular chambers 41*a* and 45*a* are respectively defined between the end plate 41 and header 42, and between end plate 45 and header 44. Chamber 45*a* is connected to the bore 2'*a* of hollow shaft 2' by radial ports 46 thus, permitting the reheated gas to flow through the bore 2'*a* of hollow shaft 2' to the inlet of a rotary compressor unit 30 which is mounted on the other side of the circular mounting plate 10 in the position previously occupied by the pressured gas distributor 6. The stationary portions 32 of compressor 30 are mounted on a support 32*a*. The outlet of rotary compressor 30 is connected by conduits 34 to the inlet ports provided in the side walls of the valve units 35.

To employ the described apparatus as an air cooling or air conditioning device, it is only necessary to provide suitable duct work and a fan for moving a stream of warm air laterally across the rotating heat transfer tubes 43. Rather than showing such conventional duct work, the flow of the air to be cooled has been schematically indicated by arrows and legends on FIG. 4.

The operation of the aforedescribed apparatus will be readily apparent to those skilled in the art. A closed circuit flow of a suitable refrigerant fluid is defined by the described apparatus. Starting with the outlet nipples 33 of the compressor 30, such flow extends through conduits 34 to the valving heads 35 provided on the outer ends of the cylinder elements 20. When each stem valve 38 is elevated to its open position by the corresponding free piston 25 arriving at its extreme radially outward position, a charge of pressured gas is fed into the fluid pressure chamber 20*a* defined within each cylinder 20. Such charge of pressured gas effects the axial displacement of the free pistons 25 toward a radially inner position relative to the rotational axis of power shaft 21, against the opposition of the centrifugal force imparted by the rotation of the pistons about such axis.

When each free piston 25 arrives at its radially innermost position, as determined by the stop ring 20*b*, the exhaust ports 20*e* are opened and the expanded, cooled gas is thus supplied through the annular header 27 and conduits 28 to the inlet side of the heat exchanger 40. The suction exerted by compressor 30 aids this gas movement. The expanded, cooled gas passes through the heat transfer tubes 43 of heat exchanger 40, absorbing heat from the room air passing thereover, and is heated thereby. The reheated gas is directed through the outlet ports 46 into bore 21*a* of the hollow power shaft 21 and then into the fluid inlet of the compressor 30.

The particular advantage of the aforedescribed system is that during the expansion movement of each piston 25 by the charge of pressured gas, the reaction force of the expanding gas is exerted on the outboard end of the fluid pressure chamber 20*a* and this force is in a direction to aid in the rotation of the power shaft 2. Thus, the energy requirements for operating this system are substantially reduced due to the extraction of mechanical energy from the expansion force of the pressured gas. More importantly, the number of moving parts has been significantly reduced.

Those skilled in the art will recognize that the aforedescribed apparatus will only effect a predetermined range of reduction in temperature of the refrigerant gas which is determined primarily by the amount that the gas is expanded. If the purpose of the apparatus is to effect room cooling, and the range of temperature reduction is on the order of 30° F., then obviously, the temperature of the pressured gas entering the plurality of piston and cylinder elements 20 must not be in excess of 100° F. or less to provide any effective amount of room cooling.

It is also obvious that the action of the compressor 30 in compressing the reheated gas will inherently increase the temperature of the gas. Accordingly, in most instances, it will be necessary to physically locate the compressor 30 and the driving motor for power shaft 2' in a separate room or chamber that is separated from the chamber to be cooled by a suitable wall of heat insulating material. Since the piston and cylinder elements 20 are rotating, such wall may most conveniently be located between the rotating body 10 and heat exchanger 40 as indicated schematically by the numeral 7 in FIG. 4.

It may also be necessary to run the compressed gas exiting from the compressor 30 through a heat exchange type cooling device and this device (not shown) should be located on the side of the heat insulating barrier 7 opposite to the heat exchanger 40. The fan (not shown) for any such gas cooling heat exchanger can, of course, be driven by power shaft 2'.

Figure 5:
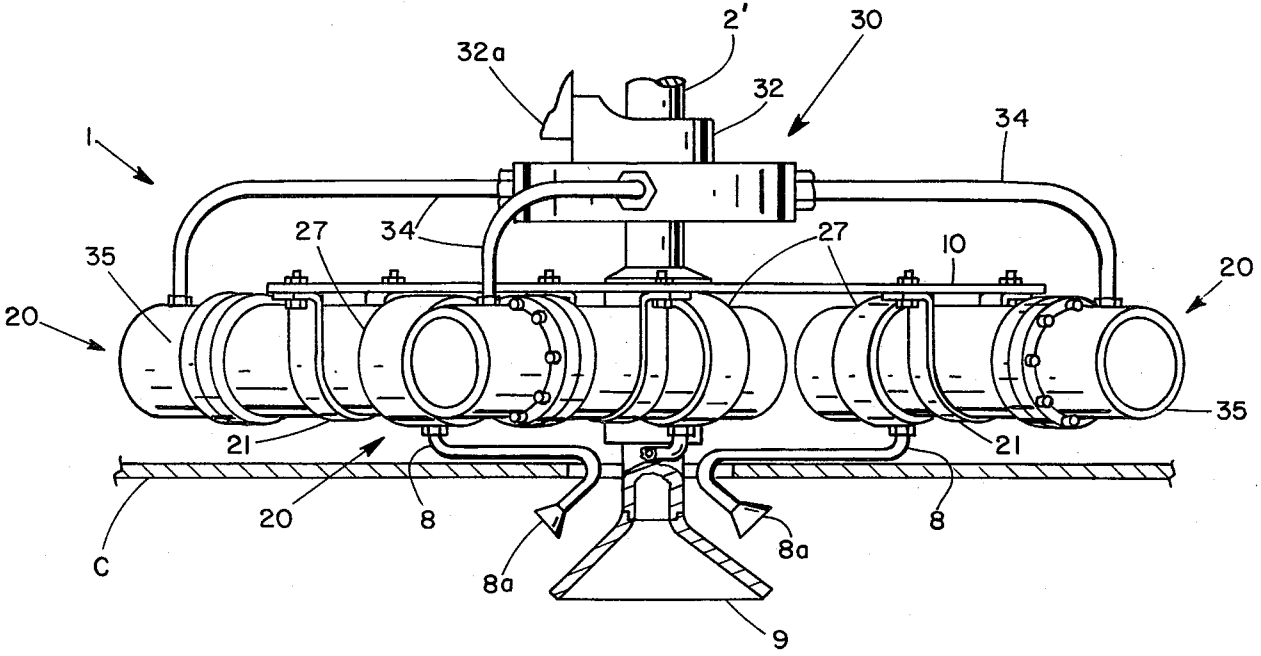
FIG. 5 is a side elevational view, partly in section, of an apparatus constructed in accordance with this invention to function as a room air cooling device wherein air is employed as a refrigerant fluid in an open cycle.

Referring now to FIG. 5, there is shown a modification of this invention wherein the apparatus 1 is constructed to function as a room air cooling device wherein air is employed as a refrigerant fluid in an open cycle. Thus, the cooled, expanded air discharged from the fluid pressure chambers 20*a* through the annular header 27 is directed into the room area to be cooled by conduits 8 and nozzle elements 8*a* which are, of course, rotating. With such an arrangement, a very efficient distribution of the cool air into the room area can be achieved by mounting the power shaft 2' in a vertical position adjacent to the ceiling C of the room and disposing of the remainder of the apparatus 1, namely the driving motor (not shown), the compressor 30 and the plurality of cylinder elements 20 each containing a free piston 25, above the ceiling C of the room to be cooled. Return air may be conveniently picked up by the open end of the power shaft 2' on which a conical baffle 9 is mounted.

From the foregoing description, it is apparent that this invention may be utilized in an apparatus which is primarily designed to extract mechanical energy from a pressured gas, as illustrated by the modification of FIGS. 1 and 2. Alternately, the principles of this invention may be employed to extract both mechanical energy and heat from a pressured gas to function as an air cooling system operating according to a closed cycle, pursuant to the modification of FIG. 4, and in an open cycle with air as a refrigerant fluid in accordance with the modification of FIG. 5.

All of these modifications of the invention may be substantially improved in their operating characteristics by increasing the length of the fluid pressure chambers 20*a* of the cylinders 20. As previously mentioned, in connection with the modification of FIGS. 1 and 2, the longer that the charge of pressured gas is permitted to operate on the free piston, the greater will be the reaction force torque applied to the rotating body. On the other hand, when the cooling capability of the apparatus is the predominant factor to be achieved, an extension of the length of the fluid pressure chambers 20*a* will permit a greater degree of expansion of the trapped charge of pressured gas, thus, achieving a greater amount of cooling. These objectives may be conveniently accomplished according to the modifications schematically illustrated in FIGS. 6–10.

Figure 6:
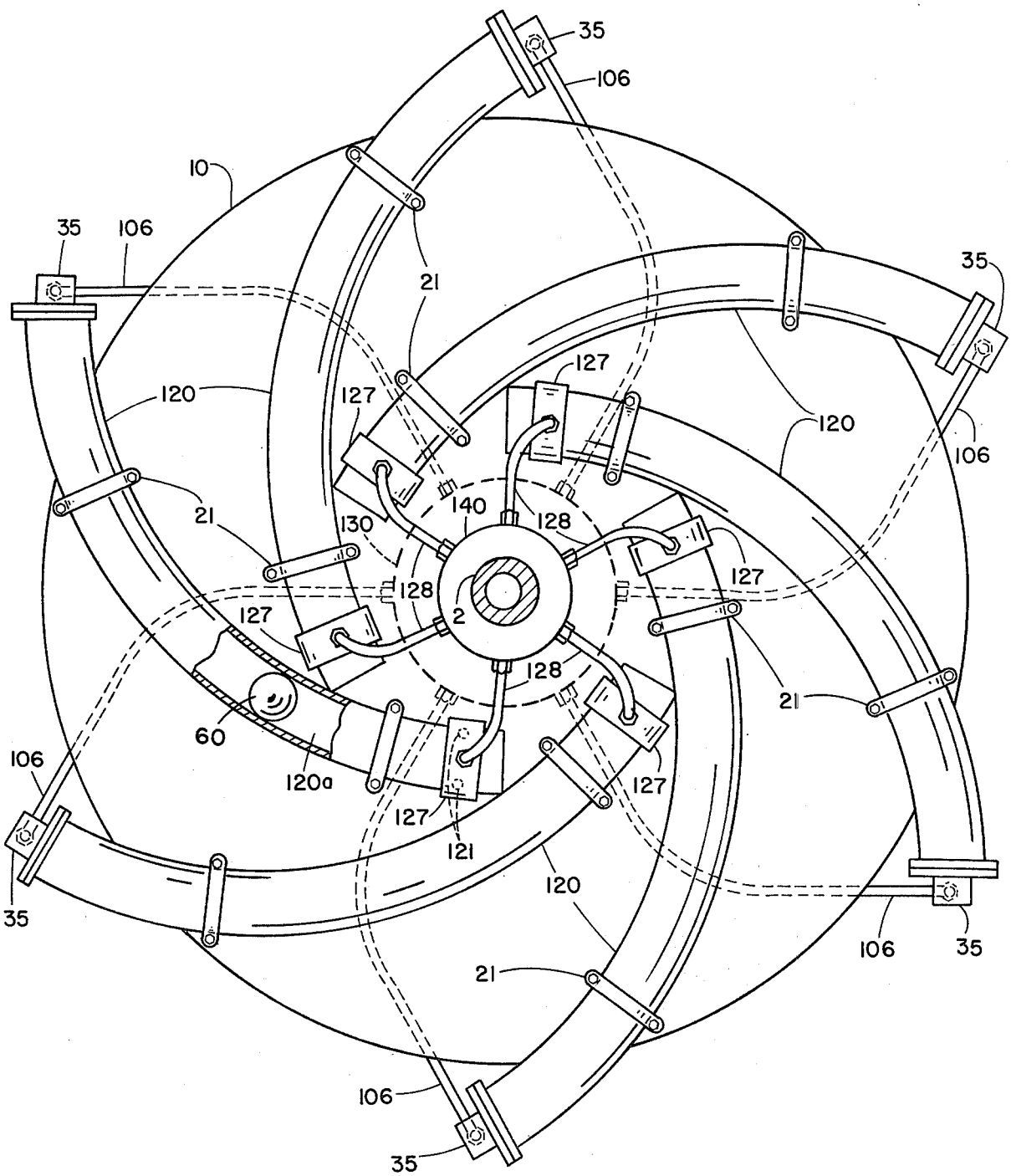
FIG. 6 is a schematic elevational view of a modified apparatus embodying this invention employing cylinder elements defining a longitudinally curved fluid pressure chamber.

Referring first to FIG. 6, a power shaft 2 drives a circular support plate 10. The cylinder elements 120 are mounted on the rotating supporting body 10 by straps 21 and supplied with pressurized gas through conduits 106 in the same manner as heretofore described, and the cooled, expanded gas is removed from the cylinders 120 by an annular header 127 surrounding a plurality of radial ports 121. However, each of the cylinders 120 defines a fluid pressure chamber 120*a* which is of uniform cross-section but has a curved longitudinal axis, thereby increasing the effective length of such chamber.

If the primary purpose of the apparatus is a prime mover, the pressured gas is supplied from a distributor similar to distributor 6 of FIGS. 1 and 2. If the primary purpose is for air cooling, the pressured gas is supplied from the outlet of a rotary compressor similar to rotary compressor 30 of FIGS. 4 and 5. Thus, the source of pressured gas is schematically indicated at 130.

For a prime mover application, the exhaust gas is fed by conduits 128 to a collector; for air cooling, it is directed into the room air pursuant to the modification of FIG. 5, or to a heat exchanger pursuant to the modification of FIG. 4, as schematically indicated at 140.

Figure 7:
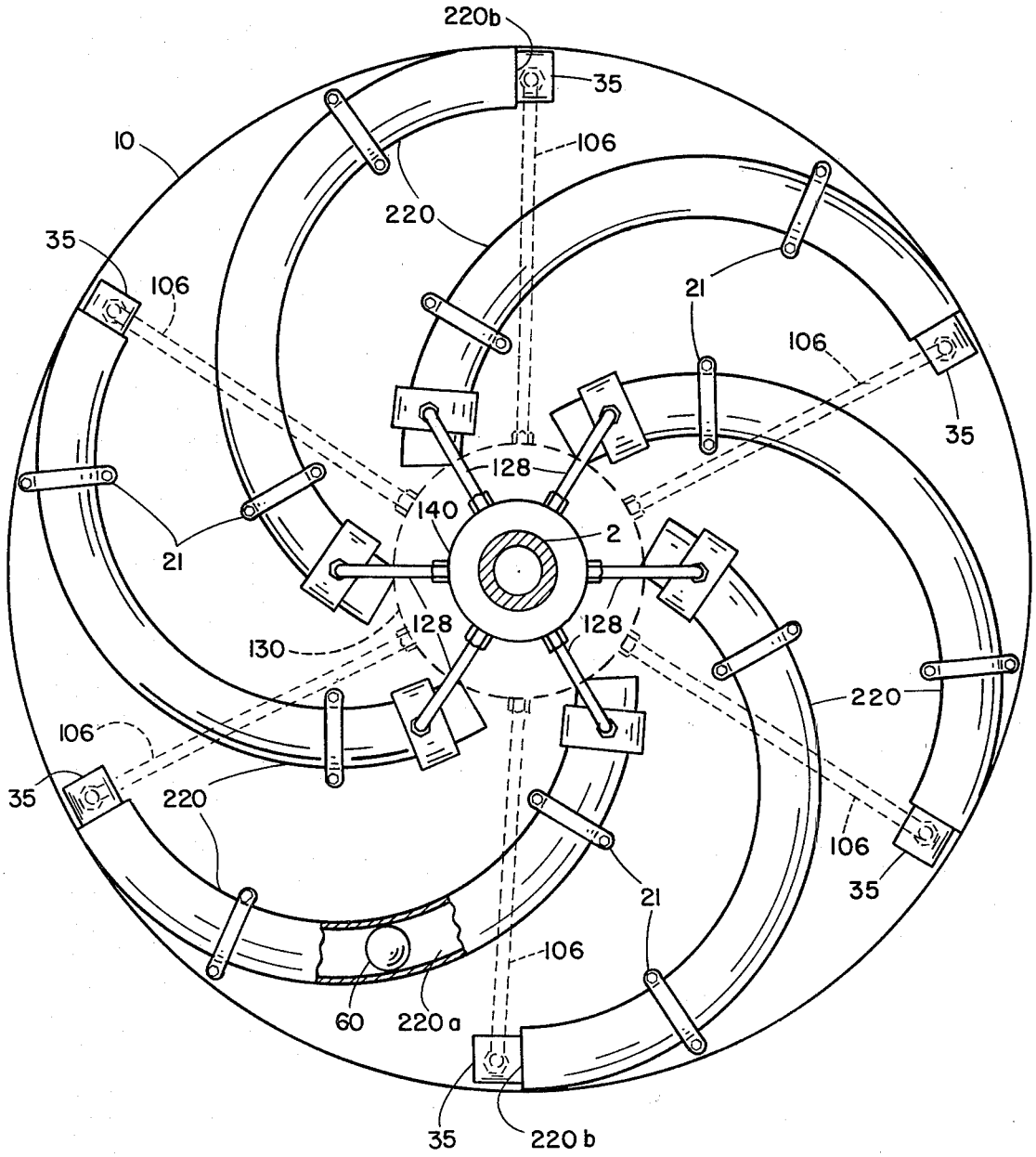
FIG. 7 is a schematic view of a further modified apparatus embodying this invention employing longitudinally curved fluid pressure chambers having generally radially disposed end walls.

In the modification of FIG. 7, the cylinders 220 are provided with longitudinally curved, fluid pressure chambers 220*a* but the degree of curvature of such chambers is such that the end wall 220*b* of the fluid pressure chamber is generally radially disposed with respect to the axis of rotation of the power shaft 2. This means that the reaction force exerted by the expanding gas on the outermost end of the cylinders 220 is at a maximum radial position relative to the axis of rotation so that the reaction torque imparted to the rotating body 10 is at a maximum.

Figure 8:
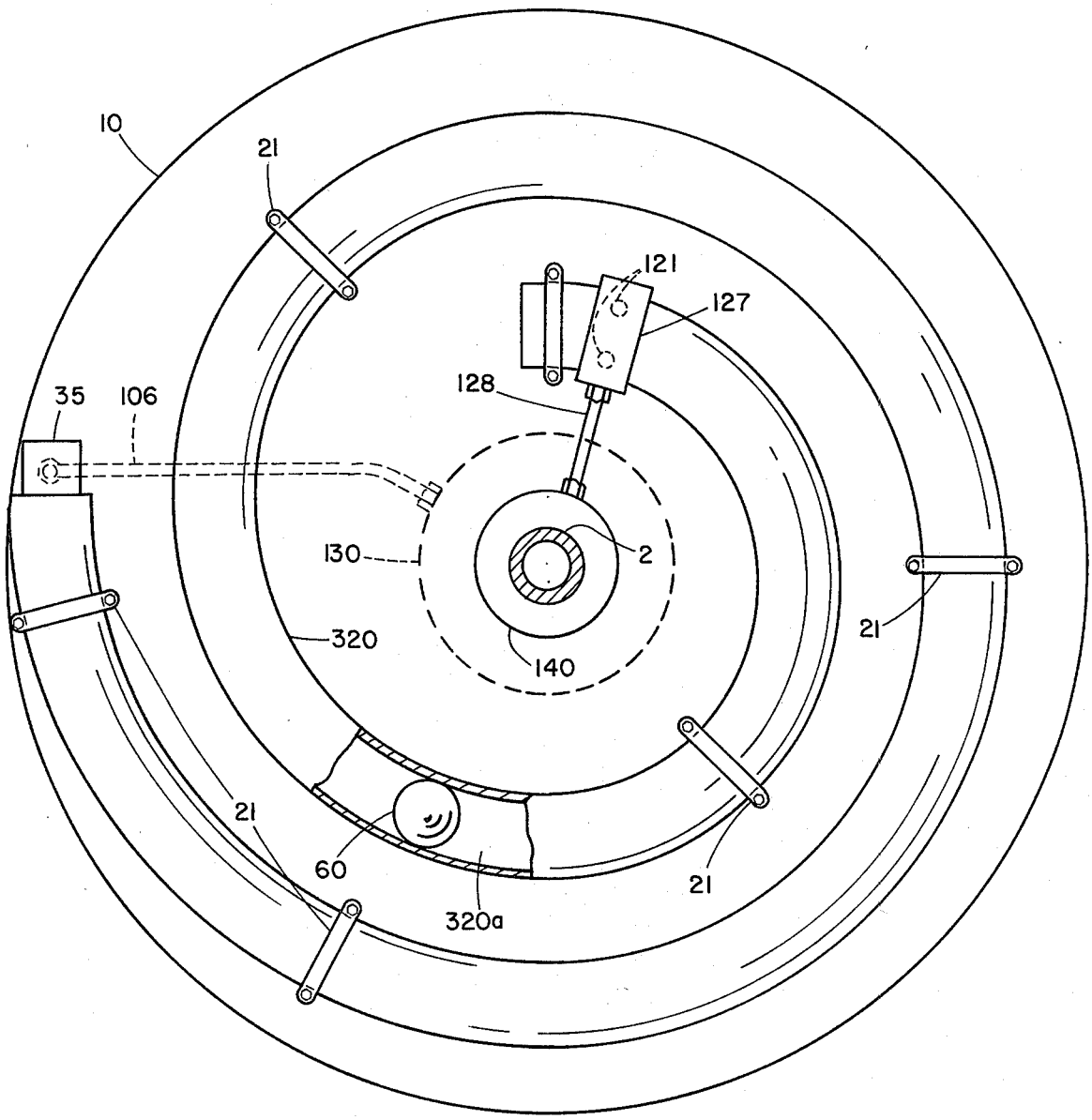
FIG. 8 is a schematic perspective view of apparatus embodying a further modification of this invention wherein the fluid pressure chamber defines a spiral path extending more than 360° around the axis of rotation.

In the modification of FIG. 8, a single cylinder element 320 is utilized which defines a fluid pressure chamber 320*a* having a spiral configuration extending more than 360° around the axis of rotation of the power shaft 2. Thus, an extremely long path of movement of the free piston is provided, but at the expense of limiting the number of cylinder elements carried by the supporting plate 10 to one. Of course, a plurality of supporting plates 10 and spiral cylinder elements 320 can be employed in axially stacked relationship on power shaft 2 if the output of additional cylinders is required.

In each of the modifications in FIGS. 6 through 8, it will be apparent to those skilled in the art that ordinary cylindrically shaped pistons cannot be employed. Instead, the free piston may take the configuration shown in FIG. 11 of a ball 60. Preferably such piston comprises a thin walled, outer metallic spherical shell 61, defined by two stamped half portions that are welded together as indicated at 61*a*, which is coated with a layer 62 of an organic plastic having both lubricating and sealing properties, such as the aforementioned plastics marketed under the trademarks "Teflon" and "Kalrez". Additionally, in order to increase the weight of the piston 60, the interior of the hollow ball is preferably filled with a heavy metal 63 which may comprise mercury, a solid mass of lead or small pellets of lead shot. Obviously, the greater the mass of free piston 60, the greater will be the gas pressure force required to overcome centrifugal forces acting on the piston to cause it to move inwardly from its radially outermost position in any of the curved fluid pressure chambers heretofore described. Moreover, the fluid pressure acting on the relatively thin-walled shell 61 will cause a compression of such shell tending to urge the periphery of the ball 60 into more intimate sealing engagement with the walls of the particular curved fluid pressure chamber in which it is employed.

Figure 12:
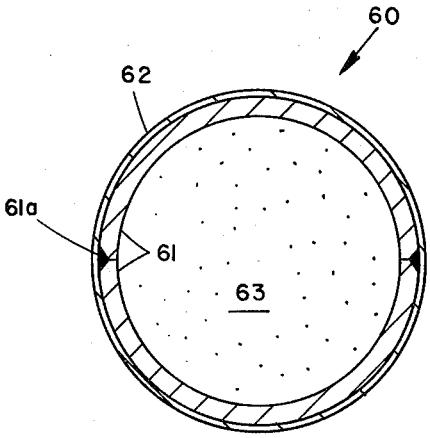
FIG. 12 is an enlarged sectional view of a ball shaped free piston.
Figure 13:
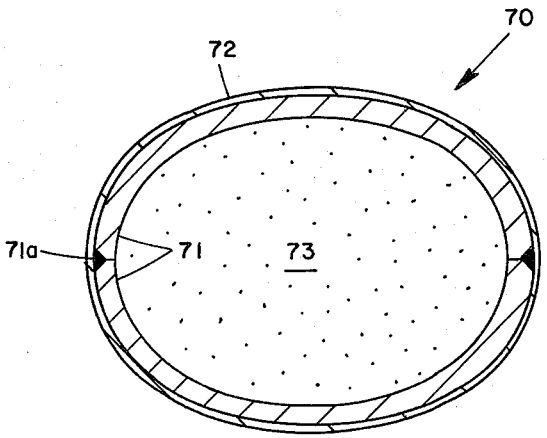
FIG. 13 is an enlarged sectional view of an ellipsoid shaped free piston.

Alternatively, as indicated in FIG. 12, a piston 70 of generally ellipsoid shape may be employed. Again, piston 70 comprises a shell 71 formed by two stamped half shell portions united by a weld 71*a*. A coating 72 of suitable organic plastic material selected for its lubricating and sealing properties is applied to the exterior of the ellipsoid shell 71. The interior of the shell is again filled with a selected one of a heavy metal 73, such as liquid mercury, solid lead or lead shot.

Those skilled in the art will recognize that the minor axis of the ellipsoid shaped piston 70 should be substantially equal to but not greater than the diameter of the particular longitudinally curved fluid pressure chamber in which the free piston is to be employed. Additionally, the major axis of the ellipsoid should be sufficiently short so as to prevent any binding of the end portions of the ellipsoid against the walls of the chamber as it traverses the curved portions of the particular longitudinally curved fluid pressure chamber.

It is recognized that the fabrication of longitudinally curved fluid pressure chambers by bending operations on tubing is accomplished with difficulty whenever it is required that the internal diameter be sufficiently uniform so as to provide sealing cooperation with a piston element. For this reason, the structure illustrated in FIG. 9 may be advantageously employed wherein a rotating body 100 comprised of two circular abutting blocks 100*a* and 100*b* are secured to the power shaft 2. The abutting faces of the blocks 100*a* and 100*b* are each machined to define recesses 101*a* and 101*b* constituting a diametrical half-portion of the particular longitudinally curved fluid pressure chambers. Ball-shaped free pistons 60 are inserted in each of the recesses and the two half block portions 100*a* and 100*b* are suitably secured in conventional manner so as to provide a sealing of the longitudinally curved fluid pressure chambers thus formed. After the block elements are assembled, threads 102 are formed in each of the radially outer ends of the longitudinally curved fluid pressure chambers and valving units 135, functionally similar to the valving units 35 heretofore described, are threadably mounted therein to control the entry of pressured gas to the fluid pressure chambers.

Figure 9:
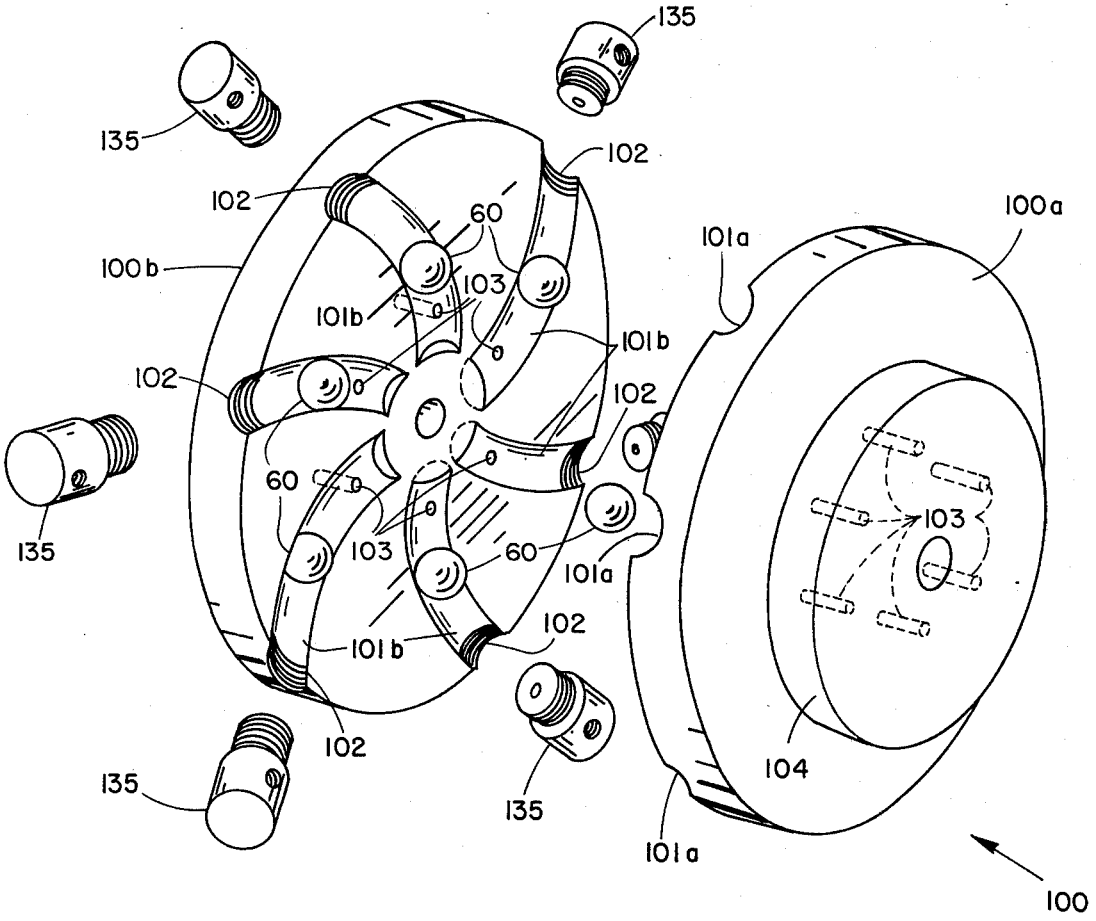
FIG. 9 is a schematic elevational view of apparatus embodying further modification of this invention wherein the longitudinally curved fluid pressure chambers are defined by juxtapositioned recesses formed in abutting surfaces of two rotating block members.

Lastly, the exhaust valves for the fluid pressure chambers defined by the juxtapositioned recesses 101*a* and 101*b* are provided with a plurality of radial ports 103 which communicate with a header 104 disposed on each exposed axial face of the rotating body block 100. The operation of the apparatus illustrated in FIG. 9 is identical to that heretofore described.

Figure 10:
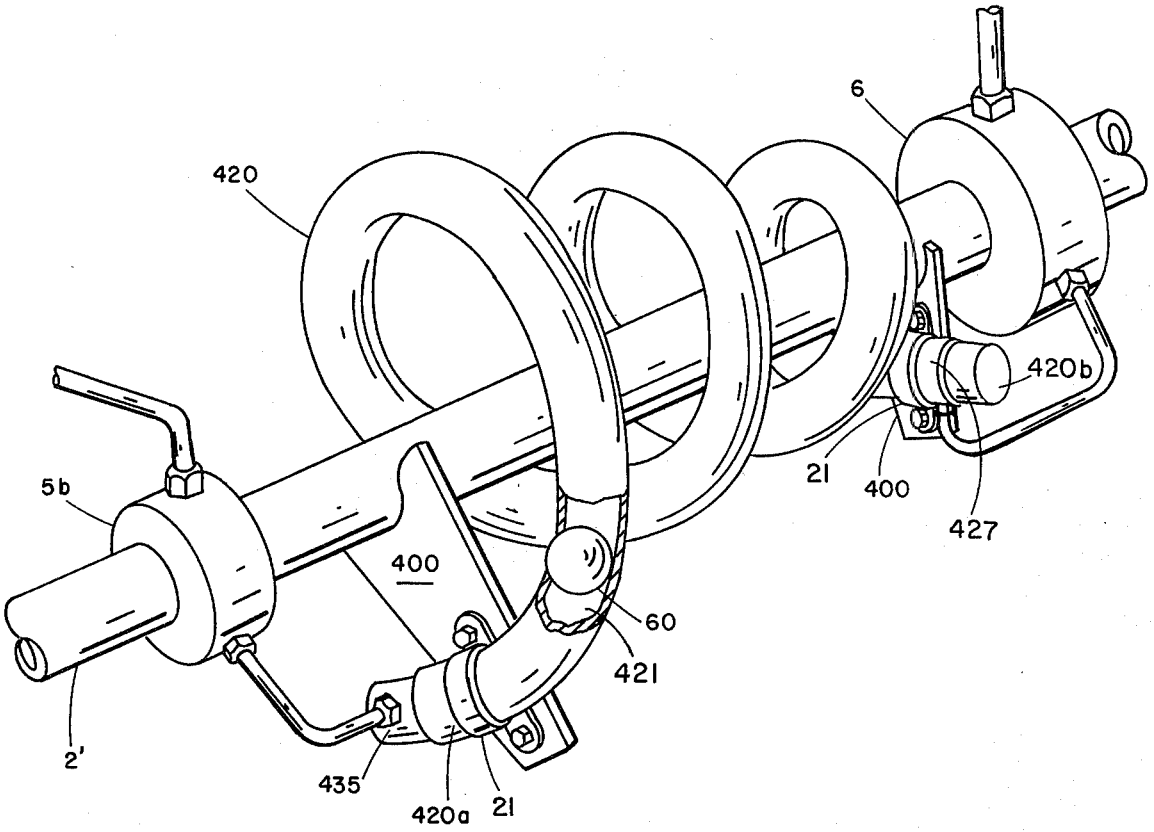
FIG. 10 is a schematic, perspective view of apparatus embodying a further modification of this invention wherein the longitudinally curved fluid pressure chamber defines a spiral-helical path, with the ends of each pressure chamber being both axially and radially spaced relative to each other.

Lastly, referring to FIG. 10, there is shown a further modification of this invention wherein the longitudinally curved fluid pressure chamber defines a spiral-helical path, represented by a spiral-helical length of tubing 420 which is secured to the rotating power shaft 2' by being secured to a plurality of radially projecting brace elements 400. The fluid pressure chamber 421 defined by the spiral-helical tubing 420 extends from an end portion 420*a* located in radially spaced relationship with respect of the axis of the power shaft 2' to an end 420*b* which is disposed closely adjacent to the axis of power shaft 2', but is axially spaced relative to the end of 420*a*. Thus, in this modification, the power shaft 2 and the radial braces 400 constitute the rotating body on which the spiral-helical tubing 420 is mounted.

A ball type free piston 60 is inserted in the fluid pressure chamber defined by tubing 420. Conventional inlet valving 435 is provided in the radially outermost end 420*a* of the fluid pressure chamber and conventional exhaust valving, including radial ports (not shown), and a header 427 are employed to respectively control the supply of pressured fluid to the fluid pressure chamber and the removal of the cooled, expanded gases therefrom in the same manner as described in connection with the prior modifications.

Figure 11:
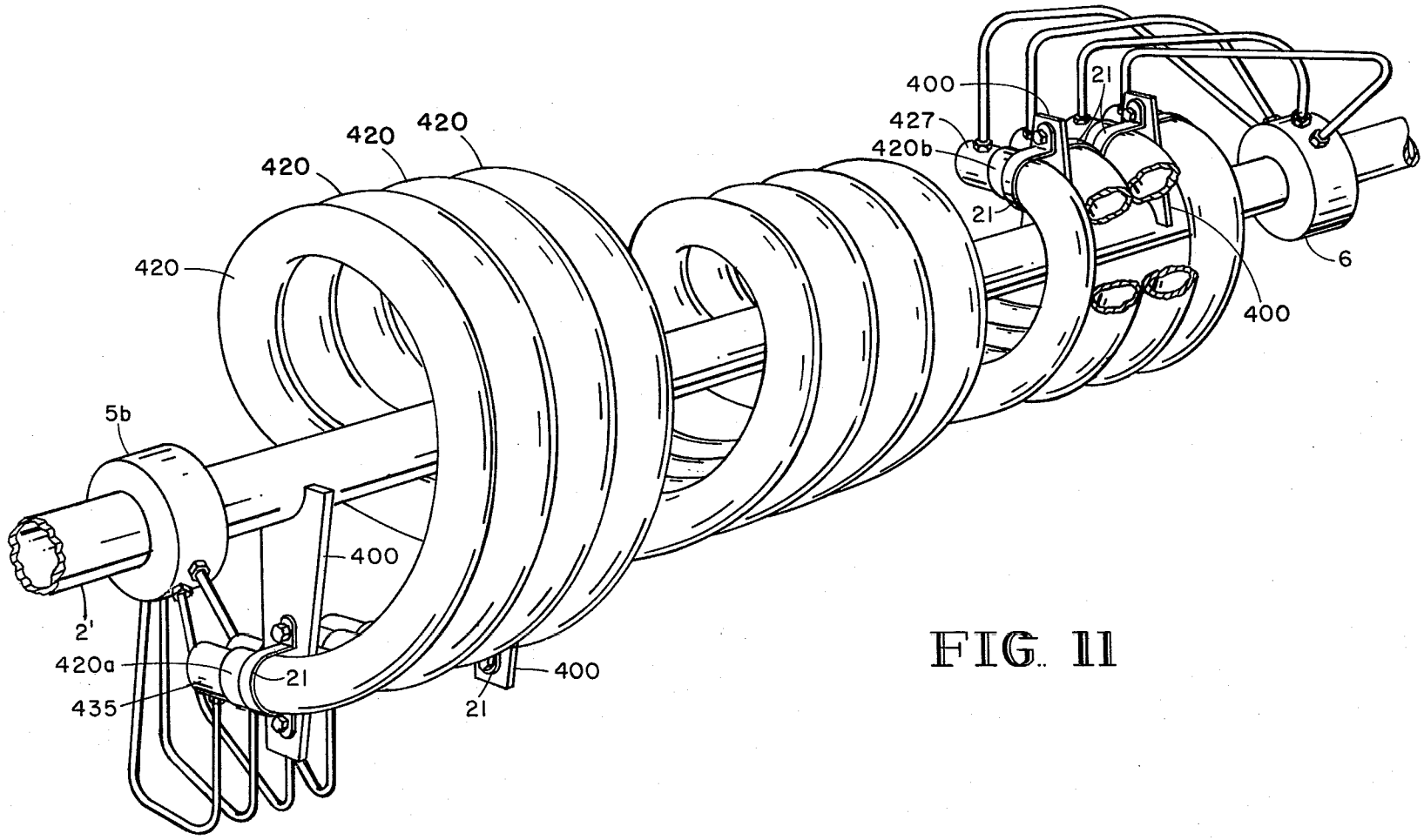
FIG. 11 is a schematic exploded perspective view of an apparatus embodying a plurality of spiral-helical fluid pressure chambers of the type disclosed in FIG. 10.

A multiplicity of spiral-helical fluid pressure chambers may be incorporated in substantially the same space as occupied by a single such chamber. Referring to FIG. 11, a plurality of such spiral-helical cylinder elements 420 are mounted on the rotating shaft 2' in essentially parallel relationship. Valving elements 435 are provided on the radially outermost ends 420*a* of each fluid pressure chamber, and conventional exhaust valving, including radial ports and a header 427, are employed to respectively control the supply of pressured fluid to the fluid pressure chamber and the removal of the cooled, expanded gases therefrom in the same manner as described in the prior modifications.

It will be recognized that in the modifications of FIGS. 10 and 11, an axial thrust will be imparted to the cylinder elements defining the spiral-helical fluid pressure chambers. Such thrust will require the mounting of the shaft 2' in thrust bearings.

Those skilled in the art will recognize that the many modifications of this invention heretofore described in detail provide the utmost flexibility in designing simplified apparatus for extraction of heat and/or mechanical energy from a pressured gas. Depending upon the desired characteristics of the apparatus, the design may result in an apparatus producing substantial amounts of mechanical energy from a pressured gas. Alternately, the apparatus may be designed to primarily effect a cooling of the pressured gas for use in an air cooling system in either an open or closed cycle, but still deriving a mechanical energy input from the pressured gas to assist in the rotation of the power shaft. Thus, the motor 3 that is provided is primarily a starting motor and necessary for the purpose for getting the device up to sufficient speed to maintain the free pistons in their radially outermost positions. After pressured gas is applied to the outermost ends of the fluid pressure chambers, the reaction force of the gas acting on the outermost ends of such chambers would produce a torque tending to increase or maintain the velocity of the rotating power shaft. Hence, an energy efficient prime mover, air conditioning or air cooling system is provided.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for extracting heat and mechanical energy from a pressured gas comprising: a body rotatable about an axis; power means for rotating said body; a plurality of cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each piston extending from a position proximate to said axis to a position remote from said axis; whereby centrifugal force will move said free piston to said remote position; inlet valve means communicating between a source of pressured gas and the remote end of each said cylinder element; means for opening said inlet valve means only when said free pistons respectively approach said remote positions to receive a charge of pressured gas in the respective fluid pressure chamber; and exhaust valve means respectively communicating with said fluid pressure chambers and operable only when said free pistons respectively approach said proximate position, whereby each charge of pressured gas imparts rotational energy to said body and is discharged in a cooled expanded condition.

2. The apparatus of claim 1 wherein said free piston comprises a container filled with one of a class of heavy metals including lead and mercury.

3. The apparatus of claim 1 wherein said free piston is exteriorly coated with an organic plastic material having lubricating and sealing properties.

4. The apparatus of claim 1 wherein said cylinder elements are of longitudinally curved configuration.

5. The apparatus of claim 1 wherein said fluid pressure chambers are of uniform circular cross-section and have a curved longitudinal axis; and said free piston comprises a sphere in external configuration.

6. The apparatus of claim 1 wherein said fluid pressure chambers are of uniform circular cross-section and have a curved longitudinal axis; and said free piston comprises an ellipsoid in external configuration, the minor diameter of said ellipsoid being substantially equal to, but less than, the internal diameter of said fluid pressure chambers.

7. The apparatus of claim 1 wherein said fluid pressure chambers are of longitudinally curved configuration and the axially remote end of each said fluid pressure chamber is defined by a wall disposed in a generally radial plane relative to said rotational axis.

8. The apparatus of claim 1, 2 or 3 wherein the longitudinal axis of said fluid pressure chamber defines a spiral path lying in a single plane.

9. The apparatus of claim 1, 2 or 3 wherein the longitudinal axis of said fluid pressure chamber defines a helical-spiral path whereby the radially outer end of said fluid pressure chamber is axially displaced from the inner end.

10. The apparatus of claim 1 wherein said rotating body comprises two plates secured in abutting relation, and said cylinder elements are defined by juxtapositioned recesses formed in the abutting faces of said plates.

11. The apparatus of claim 1, 2, 3, 4, 5, 6, 7, or 10 wherein said inlet valve means comprises a check valve mounted in the radially outer end of each fluid pressure chamber; resilient means urging said check valve to closed position; and an actuating stem on said check valve extending into said fluid pressure chamber and engagable by the respective free piston to open said check valve as said free piston moves toward said remote position.

12. The apparatus of claim 1, 2, 3, 4, 5, 6, 7, or 10 wherein said inlet valve means comprises a check valve mounted in the radially outer end of each said fluid pressure chamber; resilient means urging said check valve to closed position; an actuating stem on said check valve extending into said fluid pressure chamber and engagable by the respective free piston to open said check valve as said free piston moves toward said remote position; and adjustable time delay means for delaying the return of said check valve to closed position, thereby varying the amount of pressured gas admitted to said fluid pressure chamber.

13. The apparatus of claim 1, 2, 3, 4, 5, 6, 7, or 10 wherein said exhaust valve means comprises a plurality of radial ports in the end of each said fluid pressure chamber proximate to said axis of rotation; said radial ports being opened to exhaust the fluid pressure chamber by the inward passage of the respective piston past said radial ports.

14. The apparatus of claim 1, 2, 3, 4, 5, 6, 7, or 10 further comprising a room air heat exchanger having fluid passages therethrough; a compressor co-rotatable with said hollow body; and conduit means for circulating cooled gas from said exhaust valve means, through said fluid passages of said heat exchanger to the inlet of said compressor, and from the outlet of said compressor to the inlet valve means.

15. The apparatus of claim 1, 2, 3, 4, 5, 6, 7, or 10 wherein the pressured gas comprises air, and further comprising conduit means for connecting the exhaust valve means to a chamber to be cooled.

16. The apparatus of claim 1, 2, 3, 4, 5, 6, 7, or 10 wherein the pressured gas comprises air, and further comprising conduit means for connecting the exhaust valve means to a chamber to be cooled, a rotary compressor co-rotatable with said rotatable body; and second conduit means for connecting said chamber to the inlet of said rotary compressor and the outlet of said rotary compressor to said fluid inlet valve means.

17. Air cooling apparatus comprising, in combination, a hollow shaft mounted for rotation; a circular plate secured to said hollow shaft for co-rotation; power means for rotating said hollow shaft; a plurality of cylinder elements secured in an equi-spaced array around said axis; each said cylinder element defining an elongated fluid pressure chamber of uniform circular cross-section; a free piston movable longitudinally in each fluid pressure chamber; said cylinders being fixed on said rotatable body with the path of movement of each piston extending in a plane perpendicular to said axis from a position proximate to said axis to a position remote from said axis, whereby centrifugal force will move said free piston to said remote position; inlet valve means communicating between a source of pressured gas and the remote end of each said fluid pressure chamber, means for opening said inlet valve means only when said free pistons respectively approach said remote positions to receive a charge of pressured gas in the respective fluid pressure chambers; exhaust valve means communicating with said fluid pressure chambers and openable only when said free piston elements respectively approach said proximate positions, whereby each charge of pressured gas imparts rotational energy to said body and is discharged in a cooled expanded condition; a room air heat exchanger having fluid passages therethrough; a rotary compressor co-rotatable with said hollow shaft; and conduit means for circulating exhaust gases from said exhaust valve means through said fluid passages of said heat exchanger, through the bore of said hollow shaft to the inlet of said compressor, and from the outlet of said compressor to said inlet valve means.

18. The apparatus of claim 17 wherein said free piston comprises a container filled with one of a class of heavy metals including lead and mercury.

19. The apparatus of claim 17 wherein said free piston is exteriorly coated with an organic plastic material having lubricating and sealing properties.

20. The apparatus of claim 17 wherein said cylinder elements are of longitudinally curved configuration.

21. The apparatus of claim 17 wherein said fluid pressure chambers have a curved longitudinal axis; and said free piston comprises a sphere in external configuration.

22. The apparatus of claim 17 wherein said fluid pressure chamber has a curved longitudinal axis and said free piston comprises an ellipsoid in external configuration, the minor diameter of said ellipsoid being substantially equal to, but less than, the internal diameter of said fluid pressure chambers.

23. Air cooling apparatus comprising, in combination, a hollow shaft mounted for rotation about its axis; power means for rotating said hollow shaft, a pair of plates mounted on said hollow shaft and secured with two faces in sealed abutting relation; each said abutting face having a recess formed therein to define one diametrical half of a plurality of elongated fluid pressure chambers having a uniform cross-section and a longitudinal axis extending from a position proximate to said axis to a position remote from said axis; a free piston movable longitudinally in each said fluid pressure chamber; inlet valve means communicating between a source of pressured gas and the remote end of each said fluid pressure chamber; means for opening said inlet valve means only when said free pistons respectively approach said remote positions to receive a charge of pressured gas in the respective fluid pressure chambers; exhaust valve means communicating with said fluid pressure chambers and openable only when said free piston elements respectively approach said proximate positions, whereby each charge of pressured gas imparts rotational energy to said body and is discharged in a cooled expanded condition; a room air heat exchanger having fluid passages therethrough; a rotary compressor co-rotatable with said rotatable body; and conduit means for circulating exhaust gases from said exhaust valve means through said fluid passages of said heat exchanger, through the bore of said hollow shaft to the inlet of said compressor, and from the outlet of said compressor to said inlet valve means.

24. The apparatus of claim 23 wherein said free piston comprises a container filled with one of a class of heavy metals including lead and mercury.

25. The apparatus of claim 23 wherein said free piston is exteriorly coated with an organic plastic material having lubricating and sealing properties.

26. The apparatus of claim 23 wherein said cylinder elements are of longitudinally curved configuration.

27. The apparatus of claim 23 wherein each said free piston comprises a sphere.

28. The apparatus of claim 23 wherein each said free piston comprises an ellipsoid in external configuration, the minor diameter of said ellipsoid being substantially equal to, but less than, the internal diameter of said fluid pressure chambers.

29. The apparatus of claim 23 wherein said fluid pressure chambers are of longitudinally curved configuration and the axially remote end of each said fluid pressure chamber is defined by a wall disposed in a generally radial plane relative to said rotational axis.

30. Air cooling apparatus comprising, in combination, a hollow shaft mounted for rotation; a circular plate secured to said hollow shaft for co-rotation; power means for rotating said hollow shaft; a plurality of cylinder elements fixedly secured in an equi-spaced array around said axis; each said cylinder element defining an elongated fluid pressure chamber; a free piston movable longitudinally in each fluid pressure chamber; said cylinders being fixed on said rotatable body with the path of movement of each piston extending in a plane perpendicular to said axis from a position proximate to said axis to a position remote from said axis, whereby centrifugal force will move said free piston to said remote position; inlet valve means communicating between a source of pressured gas and the remote end of each said fluid pressure chamber; means for opening said inlet valve means only when said free pistons respectively approach said remote positions to receive a charge of pressured gas in the respective fluid pressure chambers; exhaust valve means communicating with said fluid pressure chambers and openable only when said free piston elements respectively approach said proximate positions, whereby each charge of pressured gas imparts rotational energy to said body and is discharged in a cooled expanded condition; a rotary compressor driven by said hollow shaft; and conduit means for circulating exhaust air from said exhaust valve means to a room, from the room to the bore of said hollow shaft, into the inlet of said compressor and from the outlet of said compressor to said inlet valve means.

31. The apparatus of claim 30 wherein said free piston comprises a container filled with one of a class of heavy metals including lead and mercury.

32. The apparatus of claim 30 wherein said free piston is exteriorly coated with an organic plastic material having lubricating and sealing properties.

33. The apparatus of claim 30 wherein said fluid pressure chambers are of longitudinally curved configuration.

34. The apparatus of claim 30 wherein said fluid pressure chambers are of uniform circular cross-section and have a curved longitudinal axis; and said free piston comprises a sphere in external configuration.

35. The apparatus of claim 30 wherein said fluid pressure chambers are uniform circular cross-section and have a curved longitudinal axis; and said free piston comprises an ellipsoid in external configuration, the minor diameter of said ellipsoid being substantially equal to, but less than, the internal diameter of said cylinders.

36. The apparatus of claim 30 wherein said fluid pressure chambers are of longitudinally curved configuration and the axially remote end of each said fluid pressure chamber is defined by a wall disposed in a generally radial plane relative to said rotational axis.

37. The apparatus of claim 30 wherein the longitudinal axis of said fluid pressure chamber defines a spiral path lying in a single plane.

38. The apparatus defined in claim 30 wherein the longitudinal axis of said fluid pressure chamber defines a helical-spiral path whereby the radially outer end of said fluid pressure chamber is axially displaced from the inner end.

39. The apparatus of claim 30 wherein said rotating body comprises two plates secured in abutting relation, and said cylinder elements are defined by juxtapositioned recesses formed in the abutting faces of said plates.

* * * * *